US009095773B2

(12) United States Patent
Mitelman

(10) Patent No.: US 9,095,773 B2
(45) Date of Patent: Aug. 4, 2015

(54) GAMING SYSTEM AND METHOD OF GAMING

(71) Applicant: Aristocrat Technologies Australia Pty Limited, North Ryde (AU)

(72) Inventor: Boris Mitelman, Elwood (AU)

(73) Assignee: Aristocrat Technologies Australia PTY Limited, North Ryde (AU)

( * ) Notice: Subject to any disclaimer, the term of this patent is extended or adjusted under 35 U.S.C. 154(b) by 27 days.

(21) Appl. No.: 13/707,095

(22) Filed: Dec. 6, 2012

(65) Prior Publication Data

US 2013/0095900 A1 Apr. 18, 2013

Related U.S. Application Data

(63) Continuation of application No. 12/428,126, filed on Apr. 22, 2009, now Pat. No. 8,348,736.

(30) Foreign Application Priority Data

Apr. 23, 2008 (AU) ..... 2008902020

(51) Int. Cl.
*A63F 9/24* (2006.01)
*G07F 17/32* (2006.01)

(52) U.S. Cl.
CPC . *A63F 9/24* (2013.01); *G07F 17/32* (2013.01); *G07F 17/3295* (2013.01)

(58) Field of Classification Search
None
See application file for complete search history.

(56) References Cited

U.S. PATENT DOCUMENTS

| | | | |
|---|---|---|---|
| 3,779,557 | A | 12/1973 | Kritzberg et al. |
| 2003/0211880 | A1 | 11/2003 | Locke |
| 2005/0049029 | A1 | 3/2005 | Gazdic et al. |
| 2009/0270163 | A1 | 10/2009 | Mitelman |

FOREIGN PATENT DOCUMENTS

| | | |
|---|---|---|
| CA | 2539207 | 3/2005 |
| CA | 2595133 | 1/2008 |
| DE | 3415114 | 10/1985 |

(Continued)

OTHER PUBLICATIONS

United States Patent and Trademark Office, "Restriction Requirement," issued in connection with U.S. Appl. No. 12/428,126, mailed on Oct. 4, 2011, 5 pages.

(Continued)

*Primary Examiner* — David E Graybill
(74) *Attorney, Agent, or Firm* — Hanley, Flight and Zimmerman, LLC

(57) ABSTRACT

The present disclosure provides a gaming system including a game controller arranged to generate a skill outcome in response to an input from a player and that is at least partially dependent on a skill of the player. The game controller is arranged to generate an artificial outcome that is controlled by the game controller. The gaming system also includes a game outcome controller arranged to generate a game outcome based on a criterion such that, if the criterion is met, the game outcome is at least partially determined by one of the skill outcome and the artificial outcome and, if the criterion is not met, the game outcome is at least partially determined by the other one of the skill outcome and the artificial outcome. A reward allocator is arranged to allocate a reward that is at least partially dependent on the game outcome.

17 Claims, 6 Drawing Sheets

(56) References Cited

FOREIGN PATENT DOCUMENTS

| | | |
|---|---|---|
| EA | 005390 | 2/2005 |
| GB | 2357702 | 7/2001 |
| JP | 2006218138 | 8/2006 |
| NZ | 521900 | 2/2004 |
| NZ | 530607 | 10/2005 |
| WO | 0207836 | 1/2002 |
| WO | 02062439 | 8/2002 |

OTHER PUBLICATIONS

United States Patent and Trademark Office, "Non-Final Office Action," issued in connection with U.S. Appl. No. 12/428,126, mailed on Jan. 25, 2012, 15 pages.

United States Patent and Trademark Office, "Notice of Allowance," issued in connection with U.S. Appl. No. 12/428,126, mailed on Sep. 26, 2012, 11 pages.

GAMING SYSTEM AND METHOD OF GAMING

CROSS-REFERENCE TO RELATED APPLICATIONS

The present application claims the benefit of priority to U.S. patent application Ser. No. 12/428,126, filed on Apr. 22, 2009, entitled "A GAMING SYSTEM AND A METHOD OF GAMING," and Australian Provisional Patent Application No. 2008902020, filed on Apr. 23, 2008, entitled "A GAMING SYSTEM AND METHOD OF GAMING", both of which are herein incorporated by reference in their entirety.

FIELD OF THE INVENTION

The present invention broadly relates to a gaming system and method of gaming.

BACKGROUND OF THE INVENTION

Video gaming machines, such as poker or slot machines, are widely used in many countries. Such gaming machines typically have a video display that simulates a number of spinning reels. Each reel has a number of player symbols and a selection of the player symbols is displayed on the display when the simulated reels cease spinning.

The player symbols typically are displayed in an array of display positions on the video display. A feature game component may be triggered for example if a predetermined combination of the player symbols is displayed. The feature game component may be arranged so that a skilled player is able to play a feature game component particularly well and an unskilled player may be less successful. However, a minimum return to a player percentage (RTP) is usually predetermined by legislation and, to avoid the problem that unskilled players may not reach that RTP, known gaming systems are designed so that the overall outcome of the game is largely independent of the skill of the player.

SUMMARY OF THE INVENTION

The present invention provides in a first aspect a gaming system including:

a game controller arranged to generate a skill outcome in response to an input from a player and that is at least partially dependent on a skill of the player, the game controller also being arranged to generate an artificial outcome that is controlled by the game controller;

a game outcome controller arranged to generate a game outcome based on a criterion such that, if the criterion is met, the game outcome is at least partially determined by one of the skill outcome and the artificial outcome and, if the criterion is not met, the game outcome is at least partially determined by the other one of the skill outcome and the artificial outcome; and a reward allocator arranged to allocate a reward that is at least partially dependent on the game outcome.

The game outcome controller may be arranged to generate a game outcome from a comparison of the skill outcome with the artificial outcome.

The criterion may be met if the skill outcome is more favourable for the player than the artificial outcome. Alternatively, the criterion may be met if the skill outcome is less favourable for the player.

The game outcome generator may be arranged so that the game outcome is at least partially determined by the skill outcome if the skill outcome is more favourable for the player than the artificial outcome and, if the skill outcome is less favourable for the player than the artificial outcome, at least partially determined by the artificial outcome.

Alternatively, the game outcome generator may be arranged to generate a game outcome from a comparison of the skill game outcome with a threshold outcome. The criterion may be met if the skill outcome is more favourable for the player than the threshold outcome or the criterion may be met if the skill is less favourable for the player than the threshold outcome. In this case the game outcome generator may be arranged so that the outcome is at least partially determined by the skill outcome if the skill outcome is more favourable for the player than a threshold outcome and, if the skill outcome is less favourable for the player than the threshold outcome, at least partially determined by the artificial outcome.

The game controller may be arranged so that the artificial outcome is a random outcome that may be weighted so that a return to player percentage (RTP) is above a predetermined return to play percentage.

The gaming system in accordance with embodiments of the present invention is arranged so that RTP is equal or above a predetermined RTP. Consequently, the gaming system in accordance with embodiments of the present invention provides the significant practical advantage that the game outcome may be at least partially dependent on a skill of the player, but the RTP is equal or above the predetermined RTP even if the skill of a player is low.

The gaming system may be provided in the form of a gaming machine that is arranged to implement the game or may alternatively be provided in the form of a gaming terminal that is arranged to interact with another device, such as a gaming server.

The game controller may include a first game controller component for controlling a first component game and a second game controller component for controlling a second component game. In one example the first component game is a base game and the second component game is a feature game.

The gaming system may be arranged so that an event of the first component game enables the player to play the second component game. The event may be an outcome of the first component game.

In one specific example the gaming system includes a player symbol selector arranged to select player symbols from a plurality of player symbols and a display having a plurality of individual display positions for displaying at least one selected player symbol. The event that enables the player to play the second component game may be a display of a predetermined player symbol or a display of a combination of predetermined player symbols. Further, the event may be associated with any other outcome of the first component game. In addition, the event may be associated with a purchase by the player or may be associated with any other circumstance or machine event, such as an event that is associated with a hyperlink.

The outcome of the game may solely depend on that of the first component game, the second component game or a combination of the outcomes of the first and second component games.

The gaming system may be arranged so that the second component game is an animated component game. For example, the game controller may be arranged to display game characters. In one example, the second game controller component is arranged to display at least one player game character that is associated with the player and that is at least partially controllable by the player. Further, the second game controller component may be arranged to display at least one artificial game character that may be entirely controlled by the second game controller component. The skill outcome may be associated with the at least one player game character and the artificial game outcome may be associated with the at least one artificial game character.

The gaming system may include a display having a dedicated display area which is associated with the second component game.

The player may be one of a plurality of players and the game controller may be arranged to generate a plurality of skill outcomes in response to inputs from players, typically from each player. For example, the gaming system may be arranged for playing a network game. The game outcome controller may be arranged so that the generated game outcome includes an outcome for each player.

The skill of the player may be any suitable skill, such as a skill associated with speed or movement of the player. Further the skill may be associated with an intellectual skill of the player.

The present invention provides in a second aspect a method of gaming including:

generating a skill outcome in response to an input from a player and that is at least partially dependent on a skill of the player;

generating an artificial outcome that is controlled by a game controller;

generating a game outcome based on a criterion such that, if the criterion is met, the game outcome is at least partially determined by one of the skill outcome and the artificial outcome and, if the criterion is not met, the game outcome is at least partially determined by the other one of the skill outcome and the artificial outcome; and allocating a reward that is at least partially dependent on the game outcome.

Generating the game outcome may include generating the game outcome from a comparison of the skill outcome with the artificial outcome. The criterion may be met if the skill outcome is more favourable for the player than the artificial outcome. Alternatively, the criterion may be met if the skill outcome is less favourable for the player than the artificial outcome. Generating the game outcome may be conducted so that the generated outcome is at least partially determined by the skill outcome if the skill outcome is more favourable for the player than the artificial outcome and, if the skill outcome is less favourable for the player than the artificial outcome, at least partially determined by the artificial outcome.

Alternatively, generating the game outcome may include generating the game outcome from a comparison of the skill game outcome with a threshold outcome.

In this case the criterion may be met if the skill outcome is more favourable for the player than the threshold outcome. Alternatively, the criterion may be the skill outcome is less favourable for the player the threshold outcome. In this case the step of generating the game outcome may be conducted so that the generated outcome is at least partially determined by the skill outcome if the skill outcome is more favourable for the player than the threshold outcome and, if the skill outcome is less favourable for the player than the threshold outcome, at least partially determined by the artificial outcome.

In one specific example generating the game outcome includes generating a random artificial outcome that may be weighted. The step of generating the game outcome may be conducted so that the artificial outcome results in a RTP that is equal or above a predetermined RTP.

The method may include controlling a first component game and a second component game. In one example the first component game is a base game and the second component game may be a feature game.

The method may also include enabling the player to play the second component game by an event of the first component game. The event may be an outcome of the first component game. In one specific example the method includes selecting player symbols from a plurality of player symbols and displaying at least one selected player symbol. The event that enables the player to play the second component game may be a display of a predetermined player symbol or a display of a combination of predetermined player symbols. Further, the event may be associated with any other outcome of the first component game or may be associated with any other circumstance or machine event, such as an event that is associated with a hyperlink.

The outcome of the game may solely depend on that of the first component game, the second component game or a combination of the outcomes of the first and second component games.

The second component game may be an animated game. For example, the method may include displaying game characters. In one example, the method includes displaying at least one player game character that is associated with the player and that is at least partially controllable by the player. Further, the method may include displaying at least one artificial game character that may be entirely controlled by a game controller. The skill outcome may be associated with the at least one player game character and the artificial game outcome may be associated with the at least one artificial game character.

The player may be one of a plurality of players and generating the skill outcome may include generating skill outcomes for the players, typically for each player. For example, the gaming system may be arranged for playing a network game. Further, the game outcome may be generated in a manner such that the game outcome includes an outcome for each player.

The skill of the player may be any suitable skill, such as a skill associated with speed or movement of the player. Further the skill may be associated with an intellectual skill of the player.

The present invention provides in a third aspect a computer program for instructing a computer and arranged so that, when loaded in the computer, the computer operates as a gaming system in accordance with the first aspect of the present invention.

The present invention provides in a fourth aspect a computer readable medium having a computer readable program code embodied therein for causing a computer medium to operate as a gaming system in accordance with the first aspect of the present invention.

The present invention provides in a fifth aspect a computer that is arranged for operation in accordance with the gaming system as defined by the first aspect of the present invention.

The present invention provides in a sixth aspect a data signal having a computer readable program code embodied therein and that is arranged to operate for causing a computer to operate in accordance with the gaming system of the first aspect of the present invention.

The invention will be more fully understood from the following description of specific embodiments of the invention. The description is provided with reference to the accompanying drawings.

Figure 1:
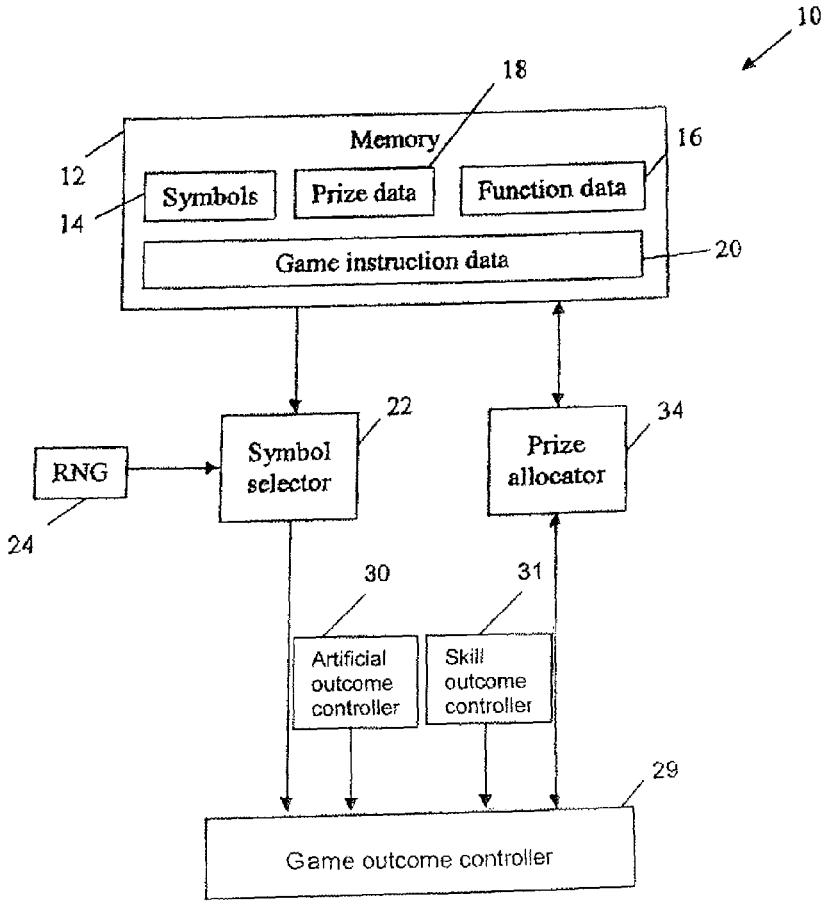
FIG. 1 is a block diagram of a gaming system in accordance with an embodiment of the present invention.

Features, further aspects, and advantages of the present invention will become apparent from the following description of embodiments thereof, by way of example only, with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION OF SPECIFIC EMBODIMENTS

Embodiments of the present invention generally concern a gaming system. In one example the gaming system includes a game controller having a first game controller component for controlling a first component game and a player symbol selector arranged to select player symbols from a plurality of player symbols. Further, the gaming system includes in one example a display having a plurality of individual display positions for displaying at least one selected player symbol.

In addition, the game controller includes in this example a second game controller component for controlling a second component game. For example, the first component game may be a base component game and the second component game may be a feature component game. The gaming system is arranged so that an event of the first component game enables the player to play the second component game. The event may be an outcome of the first component game, such as a display of a predetermined player symbol or a display of a combination of predetermined player symbols.

The second game controller component is arranged to generate a skill outcome in response to an input from the player and that is at least partially dependent on a skill of the player. The second game controller component is also arranged to generate an artificial outcome that is controlled by the second game controller component.

The display may include a dedicated area in which the second component game is displayed. For example, the display may display a first character that is controllable by the player and one or more further characters that are controlled by the second game controller component.

Further, the gaming system includes a game outcome controller arranged to generate a game outcome based on a criterion such that, if the criterion is met, the game outcome is at least partially determined by one of the skill outcome and the artificial outcome and, if the criterion is not met, the game outcome is at least partially determined by the other one of the skill outcome and the artificial outcome. In one embodiment the game outcome controller is arranged to generate a game outcome from a comparison of the skill game outcome with the artificial game outcome. The criterion is in this example that the skill outcome is more favourable for the player than the artificial outcome. The game outcome generator is arranged so that the game outcome is at least partially determined by the skill outcome if the skill outcome is more favourable for the player than the artificial outcome or, if the skill outcome is more favourable for the player than the artificial outcome, at least partially determined by the artificial outcome.

In an alternative example the game outcome generator is arranged so that the game outcome is at least partially determined by the skill outcome if the skill outcome is more favourable for the player than a threshold outcome or, if the skill outcome is less favourable for the player than the threshold outcome, at least partially determined by the artificial outcome.

The second game controller component is programmed so that the artificial outcome is a weighted random outcome and the artificial outcome results in a return to player percentage (RTP) of the game being equal or above a predetermined RTP.

Further, the gaming system includes a reward allocator that allocates a reward that is at least partially dependent on the game outcome. For example, the reward allocator may be arranged to allocate a prize or may be arranged to enable the player to play one or more free component games or multiples.

Referring now to FIG. 1, a gaming system according to an embodiment of the present invention is described. The gaming system 10 includes a memory 12 arranged to store player symbol data 14 indicative of a plurality of player symbols for selection and display to a player during a game, function data 16 indicative of one or more functions associated with one or more of the player symbols, prize data 18 indicative of prize amounts associated with win outcomes for reaching each level of the game, and game instruction data 20 indicative of game instructions usable by the gaming machine 10 to control operation of the game.

The gaming system 10 is arranged for playing a base game and includes a player symbol selector 22 which is arranged to select the player symbols for display to a player, in this example using a random number generator 24. The player symbols include at least one special player symbol. Game outcome generator 29 is arranged to generate an outcome of the base game dependent on a displayed combination of player symbols.

It will be appreciated that the random number generator 24 may be of a type which is arranged to generate pseudo random numbers based on a seed number, and that in this specification the term "random" will be understood accordingly to mean truly random or pseudo random.

The gaming system 10 is arranged so that a feature game is triggered by an event that is in this example an outcome of the base game, such as the above-described event. The outcome of the feature game may at least partially depend on a skill of the player. An artificial outcome generator 30 generates an artificial outcome and a skill outcome generator 31 generates an outcome that is dependent on a skill of the player. The game outcome controller 29 that generates an outcome of the game, which may depend on both the outcome of the base game and the feature game. Alternatively, the game outcome generator may generate an outcome that depends only on the outcome of the feature game.

In this example the game controller includes a random number generator and generates the artificial outcome. The artificial outcome is a random outcome that is weighted so that a return to player percentage (RTP) of the game is equal or above a predetermined return to play percentage.

The gaming system 10 also includes a prize allocator 34 which communicates with the prize data 18 stored in the memory 12, and with the outcome generator 29, and determines an appropriate prize to allocate to a player.

A Jackpot prize may be won if the game outcome generates an outcome associated with a higher achievement than a predetermined threshold outcome.

The prize allocator 34 may also be arranged to award monetary prizes, tokens, progressive prizes, eligibility for feature games, tournament entitlements, or special symbol entitlements in other games, such as an additional wild symbol for a predefined number of games. The gaming system 10 may be arranged so that win points or the like are contributed to a progressive Jackpot.

In the embodiment described below, the symbol selector 22, the artificial outcome generator 30, the skill outcome generator 31, the game outcome generator 29 and the prize allocator 34 are implemented using a microprocessor and associated programs, although it will be understood that other implementations are envisaged.

The gaming system 10 can take a number of different forms.

In a first form, a stand alone gaming machine is provided wherein all or most components to implement the game are present in a player operable gaming machine.

In a second form, a distributed architecture is provided wherein some of the components to implement the game are present in a player operable gaming machine and some of the components to implement the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 2:
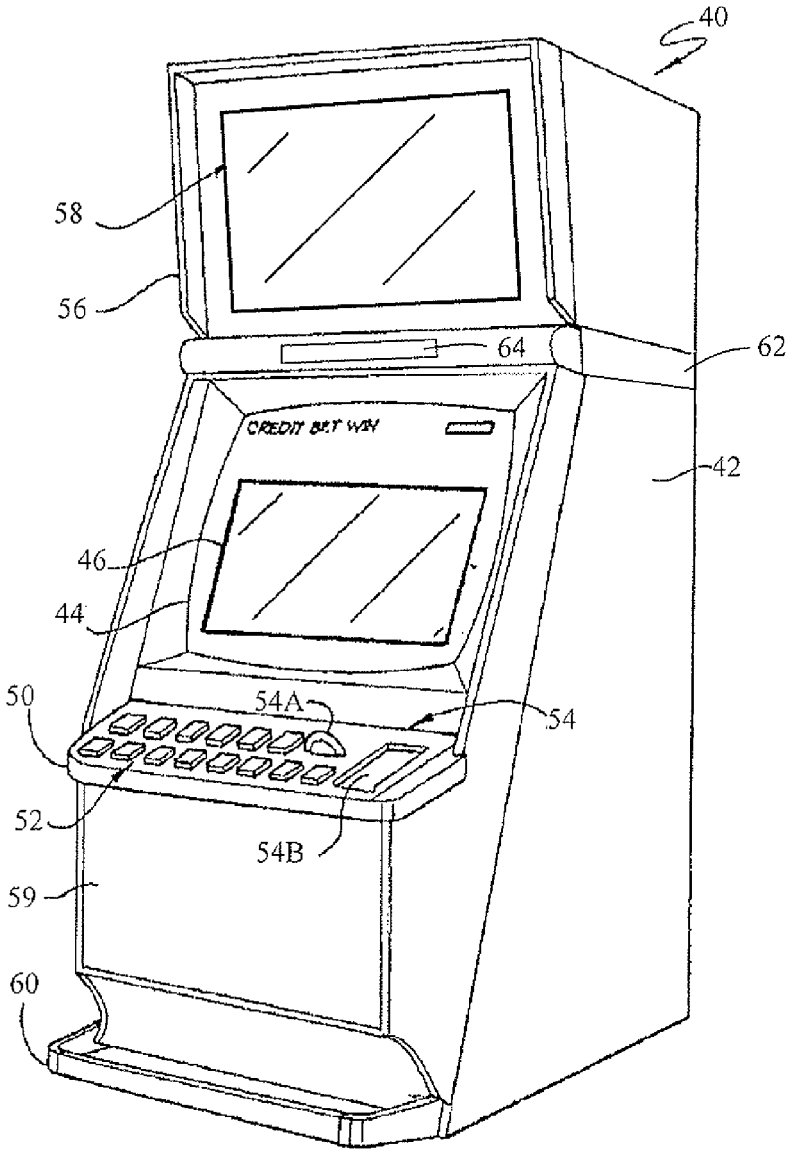
FIG. 2 is a diagrammatic representation of a gaming system in accordance with an embodiment of the present invention with the gaming system implemented in the form of a stand alone gaming machine.

A gaming system in the form of a stand alone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine during the game, control a feature of the feature game and thereby activate the skill outcome generator 31, place bets or select win lines. Alternatively or additionally, a touch screen may be provided to enable the player to interact with the gaming machine. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 40.

The display 44 is in the form of a video display unit, particularly a cathode ray tube screen device. Alternatively, the display 44 may be a liquid crystal display, plasma screen, any other suitable video display unit. The top box 56 may also include a display, for example a video display unit, which may be of the same type as the display 44, or of a different type.

The display 44 in this example is arranged to show an array having rows and columns of individual display positions, which represent several reels, each reel of which has several associated symbols. Typically 3, 4 or 5 reels are represented.

A player marketing module (PMM) 62 having a display 64 is connected to the gaming machine 40. The main purpose of the PMM 62 is to allow the player to interact with a player loyalty system. The PMM 62 has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 3:
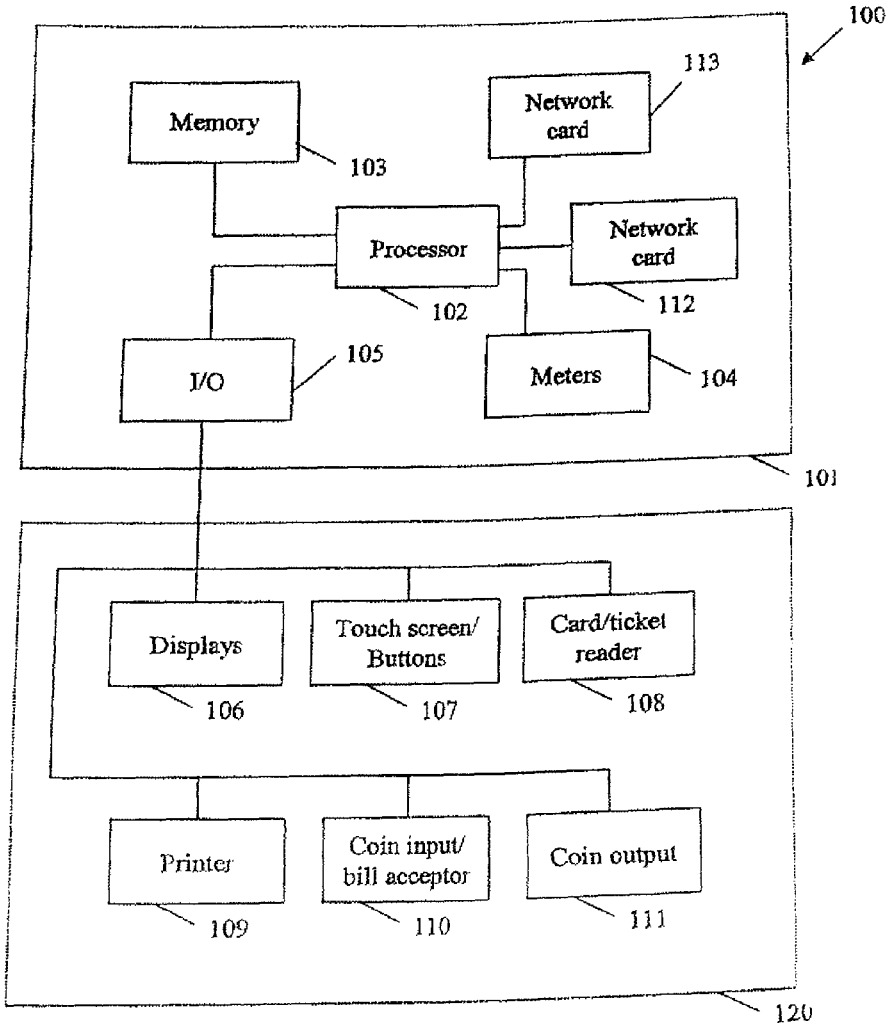
FIG. 3 is a schematic block diagram of operative components of the gaming machine shown in FIG. 2.

FIG. 3 shows a block diagram of operative components of a typical gaming machine 100 which may be the same as or different to the gaming machine shown in FIG. 2.

The gaming machine 100 includes a game controller 101 having a processor 102. Instructions and data to control operation of the processor 102 are stored in a memory 103 which is in data communication with the processor 102.

Typically, the gaming machine 100 will include both volatile and non-volatile memory and more than one of each type of memory, with such memories being collectively represented by the memory 103.

Figure 4:
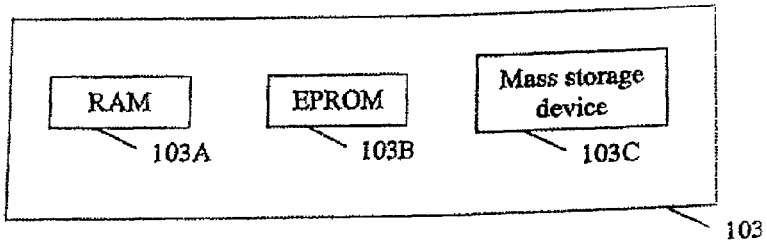
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere, and data indicative of symbols, prize amounts and symbol functions used in the game.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, the peripheral devices that communicate with the game controller 101 include one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 5:
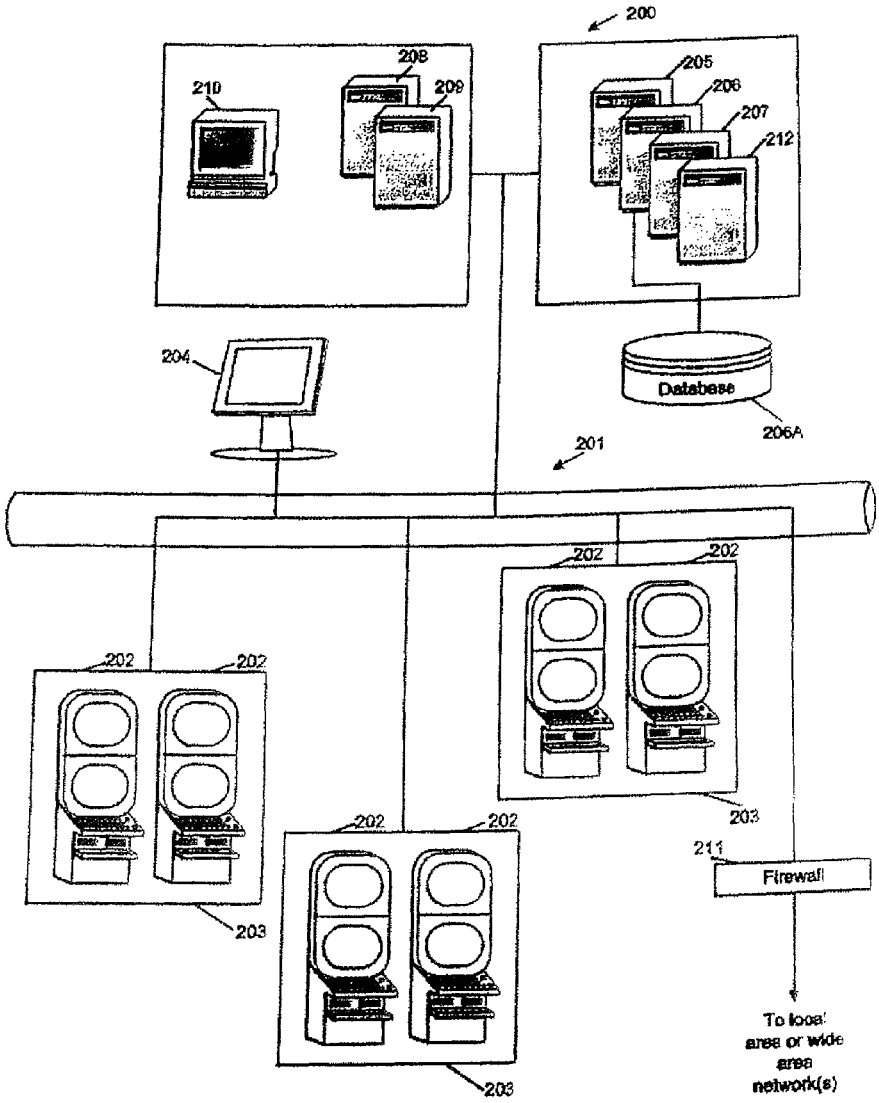
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10,100 shown in FIGS. 2 and 3, or may have simplified functionality depending on the rules, guidelines, and/or preferences to implement game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211. A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

An example of a specific implementation of the gaming system will now be described in relation to a stand alone gaming machine 40, 100, although it will be understood that implementation may also be carried out using other gaming system architectures such as a network architecture of the type shown in FIG. 5.

In the present embodiment, the gaming system 10 is arranged to display virtual symbols using a video graphical display device, although it will be understood that other arrangements are envisaged, such as reels with the symbols disposed thereon.

Figure 6:
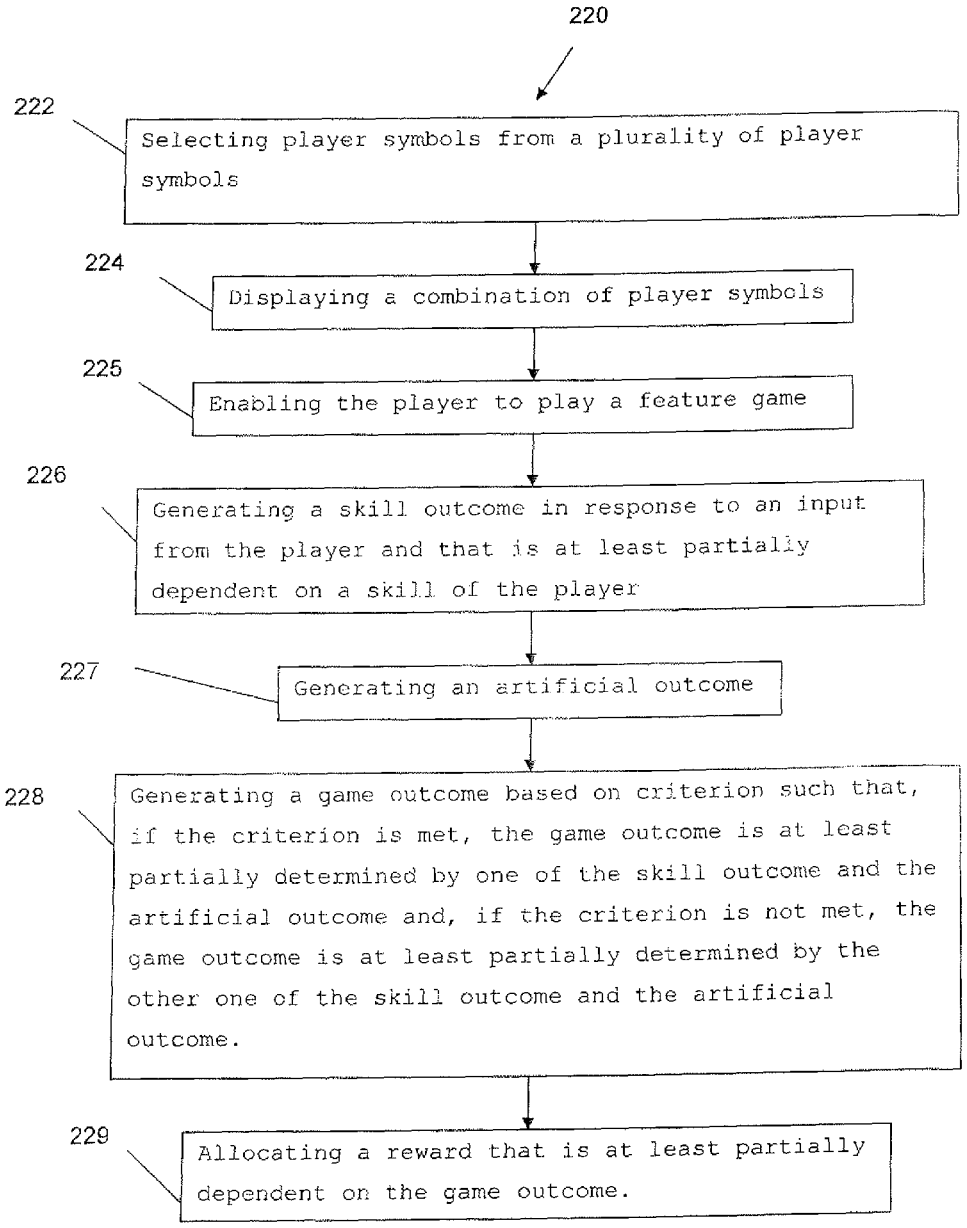
FIG. 6 is a flow diagram illustrating a method of gaming in accordance with an embodiment of the present invention.

FIG. 6 illustrates a method 220 of gaming in accordance with a specific embodiment of the present invention. The method 220 includes step 222 of selecting player symbols from a plurality of player symbols. In this example the player symbols are selected using the random number generator 24. Step 224 includes displaying a combination of player symbols. The selection may be made by a random selector. The plurality of player symbols may include special player symbols, which, if displayed, may be associated with a win or event for the player. Further, display of a predetermined combination of player symbols may also result in a win or event.

Step 225 enables the player to play a feature game. In this embodiment the player is enabled to play the feature game if an event, such as the above-described event, takes place. The feature game is in this example displayed at a separate display portion.

Figure 7:
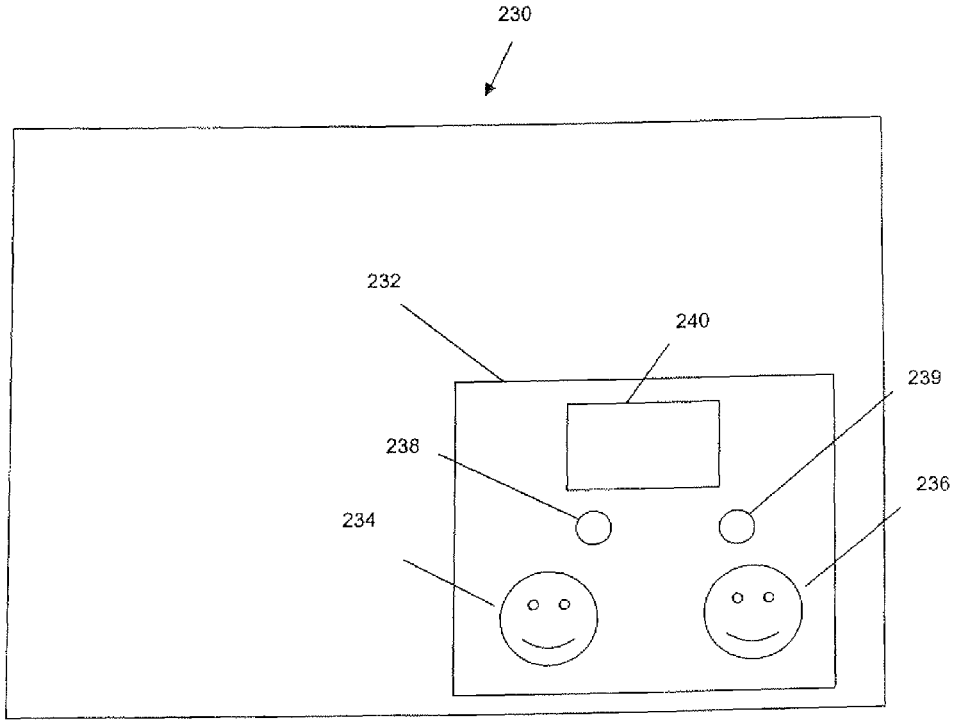
FIG. 7 is a schematic representation of a display of a gaming system in accordance with an embodiment of the present invention.

FIG. 7 schematically indicates a display 230 for displaying player symbols and including a display portion 232 for displaying the feature game. For example the display 230 may replace the display 46 shown in FIG. 2. In this embodiment displaying the feature game includes displaying feature game characters 234 and 236. The game character 234 is in this embodiment at least partially controlled by the player. The player may activate the player character 234 for example by pushing a button, such as one of the buttons 52 shown in FIG. 2, or by using a joystick or touch screen. The feature game character 236 is an artificial game character and controlled by a suitable computer program. In this example the player is enabled to activate the game character 234 so that the game character 234 is displayed as throwing objects 238, such as a ball, to a goal area 240. Further, the feature artificial game character 236 is displayed as throwing objects 239 towards the goal area 240.

The method includes step 226 of generating a skill outcome in response to an input from the player and that is at least partially dependent on the skill of the player. Further, the method 220 includes step 227 of generating a random artificial outcome that is associated with scores and object speeds that the artificial game character 236 has achieved.

In this embodiment the player has the possibility to control the player character 234 in a manner such that directions and speeds of the objects 238 are controlled.

A game outcome controller then generates a skill outcome dependent on the number of goals and the speed of the objects that hit the goal area 240.

The method 220 includes step 228 of generating a game outcome from an analysis of the skill outcome based on a criterion. In this example, the criterion is that the skill outcome, such as the number of goals achieved by the player game character, is more favourable for the player than that of the artificial character. If the criterion is met, the game outcome is at least partially determined by one of the skill outcome and the artificial outcome and, if the criterion is not met, the game outcome is at least partially determined by the other one of the skill outcome and the artificial outcome. In an alternative example the criterion may also be that the skill outcome, such as the number of goals achieved by the player game character, is more favourable for the player than a predetermined threshold outcome.

In this example the game outcome controller is arranged to generate an outcome that is partially dependent on the skill outcome if the skill outcome is more favourable for the player than the artificial outcome. Alternatively, if the artificial outcome is more favourable for the player than the skill outcome, the game outcome generator is arranged to generate an outcome that is partially dependent on the artificial outcome.

Generating the game outcome is in this embodiment conducted so that the artificial outcome is likely to be more favourable for the player than a threshold outcome. The threshold outcome is selected so that the gaming system generates outputs that are associated with a predetermined RTP.

In addition, the method 220 includes step 229 of allocating a reward that is at least partially dependent on the game outcome.

It is to be appreciated the method 220 is illustrated with respect to one of many possible examples. For example, in another variation the feature game may include displaying two or more trees or the like with randomly placed awards on branches. The awards on one tree may be multipliers and the awards on another tree may be free games. The player feature game character and the artificial feature game character have the opportunity to throw objects, such as sticks, at the trees and a "power meter" may used to determine strength and direction of each throw. In this example the player feature game character and the artificial feature game character are each presented in the form of a monkey. The artificial feature game monkey may throw the sticks at both trees with outcomes being randomized according to the weight tables. If the player feature game monkey outperforms the artificial feature game monkey, the player will be awarded one or more prizes that are associated with an achievement by the player feature game monkey. If player feature game monkey does not outperform the artificial feature game monkey, the player will be awarded one or more prize that is associated with an achievement by the artificial feature game monkey. In this example the gaming system is arranged so that the artificial feature game monkey achieves an average of a first percentage return to player of the feature game, whereas a player feature game monkey, dependent on the skills of the player, may be able to achieve an average of a second return to player percentage that is higher than the first percentage.

In another variation the player may be one of a plurality of players. The gaming system may be arranged for a network game and may generate skill outcomes each of the players. Further, the game outcome may be generated in a manner such that the game outcome includes an outcome for each player. For example, the gaming system may be arranged so that the highest award (such as numbers of free games or multipliers and the like) is awarded to the player associated with the highest achievement, while the or each other player is awarded a lesser award. Alternatively, if the skill outcome for each player is associated with a lower achievement than the artificial outcome or the predetermined threshold outcome, all players may be awarded an award that is associated with the artificial outcome.

Although the invention has been described with reference to particular examples, it will be appreciated by those skilled in the art that the invention may be embodied in many other forms. For example, any number of artificial game characters and player game characters may be displayed. For example, one or more of the artificial game characters may be displayed so that the player may not immediately be able to identify which one(s) of the characters are the artificial player characters. Alternatively, the second game component may not involve game characters. Further, the second game component may be any type of game component and may not necessarily be a feature game component. It is also to be appreciated that the skill may be any type of skill, also including an intellectual skill.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method of gaming comprising:

generating, using a processor, a skill outcome in response to an input from a player and that is at least partially dependent on a skill of the player;

generating, using the processor, an artificial outcome that is controlled by a game controller;

generating, using the processor, a game outcome based on a criterion such that, if the criterion is met, the game outcome is at least partially determined by one of the skill outcome and the artificial outcome and, if the criterion is not met, the game outcome is at least partially determined by the other one of the skill outcome and the artificial outcome; and allocating, using the processor, a reward that is at least partially dependent on the game outcome.

2. The method of claim 1 wherein generating the game outcome comprises generating the game outcome from a comparison of the skill outcome with the artificial outcome.

3. The method of claim 2 wherein generating the game outcome is conducted so that the generated outcome is at least partially determined by the skill outcome if the skill outcome is more favourable for the player than the artificial outcome and, if the skill outcome is more favourable for the player than the artificial outcome, at least partially determined by the artificial outcome.

4. The method of claim 1 wherein generating the game outcome comprises generating the game outcome from a comparison of the skill game outcome with a threshold outcome.

5. The method of claim 4 wherein generating the game outcome is conducted so that the generated outcome is at least partially determined by the skill outcome if the skill outcome is more favourable for the player than the threshold outcome and, if the skill outcome is less favourable for the player than the threshold outcome, at least partially determined by the artificial outcome.

6. The method of claim 1 wherein the step of generating the game outcome comprises generating a random artificial outcome.

7. The method of claim 6 wherein the random outcome is weighted.

8. The method of claim 1 wherein generating the game outcome is conducted so that, a return to player percentage (RTP) is equal or above a predetermined RTP.

9. The method of claim 1 comprising controlling a first component game and a second component game.

10. The method of claim 9 wherein the first component game is a base component game and the second component game is a feature component game.

11. The method of claim 9 comprising enabling the player to play the second component game by an event of the first component game.

12. The method of claim 11 wherein the event is an outcome of the first component game.

13. The method of claim 10 wherein the second component game is an animated component game.

14. The method of claim 13 wherein the method comprises displaying game characters.

15. The method of claim 14 comprising displaying at least one player game character that is associated with the player and that is at least partially controllable by the player.

16. The method of claim 14 comprising displaying at least one artificial game character that is entirely controlled by a game controller.

17. The method of claim 1 wherein the player is one of a plurality of players and generating the skill outcome comprises generating skill outcomes for each player.

* * * * *

UNITED STATES PATENT AND TRADEMARK OFFICE

CERTIFICATE OF CORRECTION

PATENT NO. : 9,095,773 B2
APPLICATION NO. : 13/707095
DATED : August 4, 2015
INVENTOR(S) : Mitelman It is certified that error appears in the above-identified patent and that said Letters Patent is hereby corrected as shown below:

In the Claims

Column 14, line 5 (Claim 6) after "wherein", delete "the step of"

Signed and Sealed this
First Day of December, 2015

Michelle K. Lee

Michelle K. Lee
*Director of the United States Patent and Trademark Office*